252-99 AU 115 EX
9/8/87 OR 4,692,260

United States Patent [19]
Sung et al.

[11] Patent Number: 4,692,260
[45] Date of Patent: Sep. 8, 1987

[54] DISHWASHING COMPOSITIONS COMPRISING AN ENZYME AND A $C_8$-$C_{10}$ ALKANOL WITH 0-2 MOLES OF PROPYLENE OXIDE

[75] Inventors: Eric Sung, Monheim; Peter Jeschke, Neuss; Klaus Schumann, Erkrath; Theodor Altenschoepfer, Duesseldorf, all of Fed. Rep. of Germany

[73] Assignee: Henkel Kommanditgesellschaft auf Aktien, Duesseldorf, Fed. Rep. of Germany

[21] Appl. No.: 757,039

[22] Filed: Jul. 19, 1985

[30] Foreign Application Priority Data

Aug. 4, 1984 [DE] Fed. Rep. of Germany ..... 3428834

[51] Int. Cl.[4] ..... C11D 3/075; C11D 3/20; C11D 3/386

[52] U.S. Cl. ..... 252/99; 252/89.1; 252/135; 252/139; 252/140; 252/174.12; 252/174.14; 252/174.21; 252/174.25; 252/DIG. 12

[58] Field of Search ..... 252/174.12, 162, 163, 252/167, DIG. 12, 135, 139, 174.21, 99, 89.1, 174.25, 174.14

[56] References Cited

U.S. PATENT DOCUMENTS

| | | | |
|---|---|---|---|
| 2,882,243 | 4/1959 | Milton | 252/455 |
| 2,882,244 | 4/1959 | Milton | 252/455 |
| 3,882,038 | 5/1975 | Clayton et al. | 252/164 |
| 3,925,224 | 12/1975 | Winston | 252/89 |
| 4,071,377 | 1/1978 | Schwuger et al. | 134/29 |
| 4,101,457 | 7/1978 | Hace et al. | 252/559 |
| 4,125,475 | 11/1978 | Kolaian et al. | 252/89 R |
| 4,280,919 | 7/1981 | Stoeckigt et al. | 252/135 |
| 4,501,681 | 2/1985 | Croutt et al. | 252/174.12 |

FOREIGN PATENT DOCUMENTS

| | | |
|---|---|---|
| 1767567 | 9/1971 | Fed. Rep. of Germany . |
| 8404324 | 4/1984 | PCT Int'l Appl. . |

*Primary Examiner*—Paul Lieberman
*Assistant Examiner*—Linda D. Skaling
*Attorney, Agent, or Firm*—Ernest G. Szoke; Henry E. Millson, Jr.; Real J. Grandmaison

[57] ABSTRACT

Dishwashing composition for the machine washing of crockery at around 40° C. which contain, in addition to polymeric alkali phosphates (di-, triphosphates), water-soluble complexing zeolites of the NaA or NaX type or organic complexing agents for calcium, alkali metasilicate, sodium carbonate, sodium hydrogen carbonate, waterglass, active oxygen donors and a low-foaming nonionic surfactant from the group of alkylene oxide adducts with $C_{12}$-$C_{18}$ alkanols, nonylphenol or with polypropylene glycols having a molecular weight of from 900 to 4000, (1) form about 0.1 to 5% by weight of a hydrolase enzyme (amylases, proteases, lipases) and, (2) as cleansing boosters, from about 0.1 to 10% by weight of $C_8$-$C_{10}$ primary, straight-chain or branched-chain alkanols which may optionally be propoxylated with from 1 to 2 moles of propylene oxide.

19 Claims, No Drawings

DISHWASHING COMPOSITIONS COMPRISING AN ENZYME AND A $C_8$–$C_{10}$ ALKANOL WITH 0–2 MOLES OF PROPYLENE OXIDE

BACKGROUND OF THE INVENTION

1. Field of the Invention

This invention relates to a composition of matter particularly useful in dishwashing compositions for hard-surfaced materials and to the dishwashing compositions themselves, which are particularly useful for washing crockery at low temperatures with minimal foaming. Substances and stains that are normally difficult to remove, such as those containing solid fat, are removed by compositions of the present invention at low washing temperatures.

2. Description of the Relevant Art

Alkaline detergent compositions used in the past for the machine washing of crockery have consisted essentially of inorganic salts, such as alkali phosphates, alkali silicates and alkali carbonates, active chlorine donors and, to improve their wetting power, have contained small amounts of a low-foaming nonionic surfactant. The compositions can show high cleansing power with respect to food remains of all kinds at normal working temperatures of from 55° to 65° C.

Improved, enzyme-containing dishwashing preparations of the type described in German Offenlegungsschrift 17 67 567, have been developed with a view to preventing the formation of thin films which can gradually build up on the surface of the crockery. These thin films, which usually consist essentially of starch and, possibly, traces of protein, may spoil the appearance of the washed crockery.

To save energy, many manufacturers have marketed energy-saving dishwashing machines which are not only reduce the water consumption of the wash liquor from 10 to about 6–7 liters, but also offer an economy program using a greatly reduced temperature. For example, the "Favorit de Luxe Elektronik i" domestic dishwashing machine marketed by AEG needs only about 6 liters of water for the wash liquor. The power consumption of the "40° C. normal" program (clear rinse temperature: 55° C.) amounts to only 1.1 kW/h as compared with the conventional consumption of 1.9 to 2.2 kW/h at 65° C. Practical experience with this machine, however, has shown that the change from the 65° C. program to the 40° C. program can reduce the cleansing power of the normal 30 g of standard dishwashing composition (approximately 5 g/l) by an average of 1.4 points in the case of 8 test residues.

To improve the performance of dishwashing compositions at the lower wash temperatures used by energy saving machines, a number of additives have been tested. For instance, the addition of 1% of an amylase-protease mixture in the wash cycle can improve the removal of oatflake and starch residues. Addition of lipase to the composition to increase the removal of fats seems to have had little effects. Despite the use of these additives, it has been difficult to remove food remains containing solid fat at temperatures around 40° C.

SUMMARY OF THE INVENTION

It has been found that the removal, at washing temperatures around 40° C., of particularly obstinate fatty stains, such as beef tallow, can be improved over normal removal results at 65° C. if, in addition to an enzyme mixture, $C_{8-10}$ primary, straight-chain or branched-chain alkanols, which may optionally be prepoxylated, are added as cleansing boosters to dishwashing compositions.

The present invention provides compositions for washing food-containing substrates, such as crockery, comprising polymeric alkali metal phosphate and/or phosphate substitutes, alkali metal silicates, alkali metal carbonates and, optionally, active oxygen donors and low-foaming nonionic surfactants, characterized in that they additionally contain at least one enzyme and at least one $C_8$–$C_{10}$ primary, straight-chain or branched-chain alkanol. The invention also relates to a composition comprising a combination of at least one enzyme and of at least one $C_8$–$C_{10}$-primary, straight-chain or branched chain alkanol, which may optionally be propoxylated.

DETAILED DESCRIPTION OF THE INVENTION

Preferably, the dishwashing compositions according to the invention comprise a combination of:

from 0 to about 50%, preferably from about 10% to 40%, by weight of a polymeric alkali metal phosphate selected from the group consisting of alkali metal diphosphates and alkali triphosphates;

from 0 to about 60%, preferably from about 5% to 50%, by weight of a suitable phosphate substitute such as (1) at least one water-insoluble, complexing zeolite of the NaA or NaX type or mixtures thereof or (2) at least one water-soluble organic complexing agent for calcium, wherein at least one suitable phosphate substitute compound or one polymeric alkali metal phosphate is present;

from about 10% to 60%, preferably from about 20% to 50%, by weight of alkali metal metasilicate;

from about 2% to 40%, preferably from about 5% to 30%, by weight of sodium carbonate;

from 0 to about 20%, preferably from about 5% to 20%, by weight of sodium hydrogen carbonate;

from about 1% to 20%, preferably from about 1% to 15%, by weight of waterglass;

from about 0.1% to 5%, preferably from about 0.5% to 3%, by weight of a hydrolase enzyme or enzyme mixture; preferably the enzyme is selected from the group consisting of amylases, proteases and lipases;

from about 0.1% to 10%, preferably from about 0.5% to 5%, by weight of $C_8$–$C_{10}$ primary, straight-chain or branched-chain alkanols which may optionally be propoxylated with from 1 to 2 moles of propylene oxide per mole of alkanol;

from 0 to about 10%, preferably from about 0.5% to 5%, by weight of active oxygen donors or even activators therefor; and from 0 to about 5%, preferably from about 0.5% to 2%, by weight of a low-foaming nonionic surfactant selected from the group consisting of alkylene oxide adducts with $C_{12}$–$C_{18}$ alkanols, nonylphenol or with polypropylene glycols having a molecular weight of from 900 to 4000.

Water may be used to form the balance of the dishwashing compositions according to the invention. The sum of all percentages of components, including water, if present, adds to 100%.

The condensed phosphates normally used in washing and rinsing compositions are commercially available or can be synthesized by means well-known in the art and may be used in the form of their alkaline, neutral or acidic sodium or potassium salts as the polymeric alkali phosphates. Representative phosphates include tetrasodium pyrophosphate, disodium dihydrogen pyrophosphate, pentasodium triphosphate, sodium hexametaphosphate and also the corresponding potassium salts and mixtures of sodium and potassium salts.

The phosphate content of detergents is often blamed for the eutrophication of waters. Its presence in detergents is, therefore, regarded as undesirable. Because of this, numerous compounds have been proposed as substitutes for the phosphates normally used in detergents and can be used in this invention. Preferred phosphate substitutes include sodium aluminium silicates in the form of synthetic zeolites of the NaA (Zeolite A) and NaX (Zeolite X) types, as described for example in U.S. Pat. Nos. 2,882,243 and 2,882,244, the disclosures of which are specifically incorporated by reference herein. These zeolites are used in their hydrated form. These zeolites may either be synthesized by means well-known in the art or obtained commercially.

Water-soluble organic complexing agents for calcium may also be used as a phosphate substitute and include, for example, polycarboxylic acids, hydroxycarboxylic acids, aminocarboxylic acids, carboxyalkyl ethers, polyanionic polymeric carboxylic acids and phosphonic acids, these compounds generally being used in the form of their water-soluble salts. Specific, but by no means complete examples of such complexing agents are citric acid, carboxymethyl tartronic acid. mellitic acid, polyacrylic acid, poly-α-hydroxyacrylic acid, carboxymethyl malic acid, nitrilotriacetic acid and 1-hydroxyethane-1, 1-diphosphonic acid. The complexing agent may either be synthesized by means well-known in the art or obtained commercially.

Any suitable alkali silicate may be used. Preferred alkali silicates are the alkali metasilicates. Water-soluble sodium or potassium metasilicates are preferably used as the alkali metasilicates. They may be anhydrous, dehydrated or contain water of crystallization and may contain from 5 to 9 moles of water. Alkali metasilicates for use in this invention may either be obtained commercially or synthesized by means well-known in the art.

The expression "waterglass" includes water-soluble sodium or potassium silicates in which the ratio of alkali oxide to silicon dioxide amounts to between about 1:2 and 1:4. They may be used in the form of anhydrous solid substances or in the form of liquid solutions, preferably approximately 50% solutions. Water-glass is available commercially or may also be synthesized by means well-known in the art.

The enzymes used may be enzymes of animal and vegetable origin, preferably active substances obtained from digestive ferments, yeasts and bacterial strains. They are generally a complex mixture of various enzymatically active substances, such as hydrolases. Particularly preferred hydrolases are amylolytic, proteolytic or lipolytic enzymes, such as amylases, proteases and lipases.

The enzymes are obtained by various processes from bacterial strains, fungi, yeasts or animal organs and are commercially available under various names. Generally, they are enzyme mixtures which have a combined effect against starch, protein and fats. The enzyme preparations obtained from *Bacillus subtillis* have a particular practical advantage because they are relatively resistant to alkalis. The temperature sensitivity of the enzymes is no longer of any real consequence.

The enzymes are adjusted to a certain degree of activity by the manufacturers, optionally through the addition of diluents, such as sodium sulfate, sodium chloride, alkali phosphates or alkali polyphosphates. Normally, the activity of proteolytic enzymes is expressed in LVU/g (Lohlein-Volhard Units per gram), IU (International Units) and DU/g (Delfter Units per gram). Because of the simple analytical method involved, their activity is frequently expressed in LVU/g. In the dishwashing compositions according to the invention, the proteolytic enzyme activity is preferably from about 100 to 5000, more preferably from 200 to 2000 LVU/g.

The amylolytic activity is generally expressed in SKB/g (Sandstedt-Kneen-Blish Units per gram). In the dishwashing compositions according to the invention, the amylolytic actvity is preferably from about 5 to 1000, more preferably from above 15 to 250 SKB/g. The quantity in which the enzymes are used in the dishwashing compositions according to the invention is determined by those values.

The primary, straight-chain or branched-chain alkanols contain from about 8 to 10 carbon atoms in the alkyl radical and may be propoxylated with 1 to 2 moles, preferably with 2 moles, of propylene oxide per mole of alkanol. Preferred alkanols include, for example, n-octanol, 2-ethylhexanol, isononyl alcohol, n-decanol, isodecanol and, preferably, n-octanol + 2 moles of propylene oxide (PO). The alkanols for use in the present invention may be synthesized by means well-known in the art or obtained commercially.

The active oxygen donors useful in the present invention include the known alkali perborates, persulfates and percarbonates, which may be activated by such activators as tetraacetyl ethylene diamine, tetraacetyl glycol uril and pentaacetyl glucose, and also compounds such as magnesium monoperphthalate which do not require activation. Suitable oxygen donors and activators may either be synthesized by means well-known in the art or obtained commercially.

Any suitable nonionic low-foaming surfactant may be used. Preferred nonionic low-foaming surfactants are ethylene oxide adducts with relatively high molecular weight polypropylene glycols having molecular weights of from 900 to 4000 and also ethylene oxide or ethylene oxide and propylene oxide adducts with $C_{12}$–$C_{18}$ alkanols and nonylphenol. The adducts are produced in known manner by addition of the corresponding alkylene oxides in the presence of generally alkaline catalysts, optionally under pressure and at elevated temperature. Up to three times the quantity by weight of the starting compounds may be added onto alkylene oxides. Examples of suitable adducts are the adduct of 10% by weight of ethylene oxide with a polyoxypropylene glycol having a molecular weight of 1750 and also the adduct of 9 moles of ethylene oxide and 10 moles of propylene oxide with nonylphenol and the like.

Suitable nonionic surfactants also include surface-active amine oxides which are mostly derived from tertiary amines containing a hydrophobic $C_{10}$–$C_{12}$ alkyl group and two shorter alkyl and/or alkylol groups each containing up to 4 carbon atoms. Typical representatives are, for example, the compounds N-dodecyl-N,N-dimethylamine oxide, N-tetradecyl-N,N-dihydroxyethylamine oxide and N-hexadecyl-N,N-bis-(2,3-dihydroxypropyl)-amine oxide. Suitable surfactants may either be synthesized by means well-known in the art or obtained commercially.

In addition to the above-mentioned constituents, the claimed compositions may also contain other well-known components, particularly inorganic salts, such as sodium sulfate, as diluents. In addition, acid- or alkaline-reacting or buffering inorganic or organic compounds may be used to adjust the pH-value to optimize use of the enzymes. The organic hydroxycarboxylic acids also used as complexing agents, such as citric acid or tartaric acid, and also phosphoric acid or acidic alkali orthophosphates, are preferably used for pH-adjustment. In general, the pH-values of the dishwashing composition of the present invention range from about 4 to 12, depending on the type of enzyme used. Finally, enzyme-activating additives, such as ammonium chloride, sodium chloride, dyes, perfumes and the like may be added to the compositions.

The claimed compositions are generally used in the form of mixtures of granular or powder-form individual substances or as granulated, agglomerated or prilled products.

The claimed dishwashing compositions can be distinguished by their strong wetting effect and by their extremely good low-temperature cleansing power, particularly with respect to obstinate food remains, such as fat-, protein- and starch-containing remains.

The powder-form, granulated, agglomerated or prilled compositions are applied by introduction into the wash liquor either by hand or preferably by means of automatic dispensers. The in-use concentrations in the wash liquor should amount to between about 2 and 7 g/l for temperatures of from about 40° to 45° C.

To test the cleansing power of the compositions according to the invention, plates containing potato starch and porridge remains and also wax crayon and solid fat coatings, dishes containing milk, blancmange and minced-meat remains and also cups containing dried tea remains were machine-washed. The tests were carried out in an AEG "Favorit de Luxe Electronik i" domestic dishwashing machine using Dusseldorf city water (16° German hardness), the machine used having the following program steps:

| | |
|---|---|
| 1. cold prerinse,<br>2. 40° C. wash,<br>3. <40° C. rinse,<br>4. <40° C. rinse,<br>5. 55° C. clear rinse,<br>6. drying. | total program time<br>60 minutes |

30 g of dishwashing composition corresponding to 5 g/l of liquor were used for the wash cycle. No rinse aid was used in the clear rinse cycle to avoid falsifying the cleansing results. On completion of the program, the cleansing power of the respective compositions used was visually assessed using a Points system ranging from 0 to 10, 0 points meaning "no discernible cleansing effect" and 10 points meaning "complete removal of the test remains."

This system produced a number of intermediate values which enabled differentiating evaluations to be made. The results represent average values of 4 parallel evaluations by 4 examiners.

The test remains consisted of porridge and starch in the form of mashed potato which had been applied to plates and scraped off. Thereafter, the plates were left standing for 6 hours in air at room temperature and then loaded into the dishwashing machine. The beef tallow covering was prepared as follows: from 0.5 to 0.8 g of beef tallow were melted and approximately 2% of titanium dioxide stirred into the resulting melt. The mass was then uniformly brushed while still warm onto red plastic plates. The plates were first washed with a standard dishwashing preparation (A) which had the following composition:

Preparation A

40% by weight of sodium triphosphate, anhydrous,
45% by weight of sodium metasilicate, anhydrous,
5% by weight of sodium carbonate, anhydrous, balance water.

Other dishwashing compositions using other inorganic complexing agents, such as for example sodium aluminium silicates of the zeolite NaA or NaX type, or organic complexing agents, such as for example the sodium salt of nitrilotriacetic acid, as partial or complete phosphate substitutes, were included in the tests. These preparations had the following compositions:

Preparation B

20% by weight of sodium triphosphate, anhydrous,
20% by weight of zeolite NaA (expressed as anhydrous substance),
45% by weight of sodium metasilicate, anhydrous,
5% by weight of sodium carbonate, anhydrous, balance water.

Preparation C

40% by weight of zeolite NaA (expressed as anhydrous substance),
45% by weight of sodium metasilicate, anhydrous,
5% by weight of sodium carbonate, anhydrous, balance water.

Preparation D

20% by weight of sodium triphosphate, anhydrous,
20% by weight of nitrilotriacetic acid, sodium salt,
45% by weight of sodium metasilicate, anhydrous,
5% by weight of sodium carbonate, anhydrous, balance water.

Preparation E

40% by weight of nitrilotriacetic acid, sodium salt
45% by weight of sodium metasilicate, anhydrous,
5% by weight of sodium carbonate, anhydrous, balance water.

The results of the dishwashing tests, shown in Table 1 below, demonstrate that the use of dishwashing compositions having the conventionally varied formulations specified above results in considerably poorer cleansing when the washing temperature is reduced by 25° C. from 65° C. to 40° C.

TABLE 1

Dishwashing tests with an AEG Favorit de Luxe Elektronic i (using 6 liters of water in the wash cycle)
Dosage: 30 g of preparations A–E (approximately 5 g/l)

| | PREPARATION | | | | |
|---|---|---|---|---|---|
| Program | A | B | C | D | E |
| | | Oakflakes | | | |
| 65° C. | 5 | 5 | 5 | 5.5 | 5 |
| 40° C. | 4.75 | 4 | 4 | 4 | 4.25 |
| Δ | −0.25 | −1 | −1 | −1.5 | −0.75 |
| | | Starch | | | |
| 65° C. | 5 | 5.5 | 4.75 | 5.5 | 5 |
| 40° C. | 3.75 | 4.5 | 4 | 4.75 | 4 |
| Δ | −1.25 | −1 | −0.75 | −0.75 | −1 |
| | | Beef tallow | | | |

TABLE 1-continued

Dishwashing tests with an AEG Favorit de Luxe Elektronic i (using 6 liters of water in the wash cycle)
Dosage: 30 g of preparations A–E (approximately 5 g/l)

| | PREPARATION | | | | |
|---|---|---|---|---|---|
| Program | A | B | C | D | E |
| 65° C. | 5.25 | 5 | 5.5 | 5.25 | 5.5 |
| 40° C. | 3.75 | 2.5 | 2.25 | 2.0 | 2.25 |
| Δ | −1.50 | −2.5 | −2.25 | −2.25 | −2.25 |

In the following Examples, 4% by weight (1.2 g) of the sodium metasilicate of standard preparation A, B, C, D, or E, as indicated in Tables 2–4, was replaced by 1% by weight (0.3 g) of a 1:1 mixture of amylase and protease (Maxamyl ® and Maxatase ® products of Koninklijke Nederlandsche Gist en Spiritus-Fabriek N.V., Delft) and 3% by weight (0.9 g) of the products listed in the following Table.

TABLE 2

| No. | Program | Formulation | Points removal of beef tallow | Compared with preparation A–E Δ(65° C.) |
|---|---|---|---|---|
| A | normal 65° C. | 30 g standard preparation A | 5.25 | — |
| B | normal 40° C. | 30 g standard preparation A | 3.75 | −1.50 |
| 1 | normal 40° C. | 28.8 g standard preparation A +0.3 g enzyme mixture +0.9 g n-octanol | 6.50 | +1.25 |
| 2 | normal 40° C. | 28.8 g standard +0.3 g enzyme mixture +0.9 g n-octanol + 2PO | 9.00 | +3.75 |
| 3 | normal 40° C. | 28.8 g standard +0.3 g enzyme mixture +0.9 g n-decanol + 2 PO | 8.50 | +3.25 |
| 4 | normal 40° C. | 28.8 g standard preparation A +0.3 g enzyme mixture +0.9 g 2-ethylhexanol | 6.25 | +1.00 |
| 5 | normal 40° C. | 28.8 g standard preparation A +0.3 g enzyme mixture +0.9 g isononyl alcohol | 5.75 | +0.50 |
| 6 | normal 40° C. | 28.8 g standard preparation A +0.3 g enzyme mixture +0.9 g isodecanol | 6.50 | +1.25 |
| 7 | normal 40° C. | 28.8 g standard preparation B +0.3 enzyme mixture +0.9 g n-octanol + 2 PO | 7.50 | +2.50 |
| 8 | normal 40° C. | 28.8 g standard preparation C +0.3 g enzyme mixture +0.9 g n-octanol + 2 PO | 7.50 | +2.00 |
| 9 | normal 40° C. | 28.8 g standard preparation D +0.3 g enzyme mixture +0.9 g n-octanol + 2 PO | 8.00 | +2 75 |
| 10 | normal 40° C. | 28.8 g of standard preparation E +0.3 g enzyme mixture +0.9 g n-octanol + 2 PO | 8.00 | +2.50 |

TABLE 3

| No. | Program | Formulation | Points oatflakes | Compared with preparation A–E Δ(65° C.) |
|---|---|---|---|---|
| A | normal 65° C. | 30 g standard preparation A | 5.00 | — |
| B | normal 40° C. | 30 g standard preparation A | 4.25 | −0.75 |
| 1 | normal 40° C. | 28.8 g standard preparation A +0.3 g enzyme mixture +0.9 g n-octanol | 5.00 | ±0 |
| 2 | normal 40° C. | 28.8 g standard preparation A +0.3 g enzyme mixture +0.9 g n-octanol + 2 PO | 6.00 | +1.00 |
| 3 | normal 40° C. | 28.8 g standard preparation A +0.3 g enzyme mixture 0.9 g n-decanol + 2 PO | 6.25 | +1.25 |
| 4 | normal 40° C. | 28.8 g standard preparation A +0.3 g enzyme mixture +0.9 g 2-ethylhexanol | 5.00 | ±0 |
| 5 | normal 40° C. | 28.8 g standard preparation A +0.3 enzyme mixture | 5.00 | ±0 |

TABLE 3-continued

| No. | Program | Formulation | Points oatflakes | Compared with preparation A-E Δ(65° C.) |
|---|---|---|---|---|
| | | +0.9 g isononyl alcohol | | |
| 6 | normal 40° C. | 28.8 g standard preparation A +0.3 g enzyme mixture +0.9 g isodecanol | 5.25 | +0.25 |
| 7 | normal 40° C. | 28.8 g standard preparation B +0.3 g enzyme mixture +0.9 g n-octanol + 2 PO | 6.25 | +1.25 |
| 8 | normal 40° C. | 28.8 g standard preparation C +0.3 g enzyme mixture +0.9 g n-octanol + 2 PO | 6.00 | +1.00 |
| 9 | normal 40° C. | 28.8 g standard preparation D +0.3 g enzyme mixture +0.9 g n-octanol + 2 PO | 6.25 | +0.75 |
| 10 | normal 40° C. | 28.8 g standard preparation E 0.3 g enzyme mixture +0.9 g n-octanol + 2 PO | 6.50 | +1.50 |

TABLE 4

| No. | Program | Formulation | Points starch | Compared with preparation A-E Δ(65° C.) |
|---|---|---|---|---|
| A | normal 65° C. | 30 g standard preparation A | 5.00 | — |
| B | normal 40° C. | 30 g standard preparation A | 3.75 | −1.25 |
| 1 | normal 40° C. | 28.8 g standard preparation A +0.3 g enzyme mixture +0.9 g n-octanol | 6.75 | +1.75 |
| 2 | normal 40° C. | 28.8 g standard preparation A +0.3 g enzyme mixture +0.9 g n-octanol + 2 PO | 6.00 | +1.00 |
| 3 | normal 40° C. | 28.8 g standard preparation A +0.3 g enzyme mixture +0.9 g n-decanol + 2 PO | 6.25 | +1.25 |
| 4 | normal 40° C. | 28.8 g standard preparation A +0.3 g enzyme mixture +0.9 g 2-ethylhexanol | 6.25 | +1.25 |
| 5 | normal 40° C. | 28.8 g standard preparation A +0.3 g enzyme mixture +0.9 g isononyl alcohol | 5.75 | +0.75 |
| 6 | normal 40° C. | 28.8 g standard preparation A +0.3 g enzyme mixture +0.9 g isodecanol | 6.00 | +1.00 |
| 7 | normal 40° C. | 28.8 g standard preparation B +0.3 g enzyme mixture +0.9 g n-octanol + 2 PO | 7.25 | +1.75 |
| 8 | normal 40° C. | 28.8 standard preparation C +0.3 g enzyme mixture +0.9 g n-octanol + 2 PO | 7.00 | +2.25 |
| 9 | normal 40° C. | 28.8 g standard preparation D +0.3 g enzyme mixture +0.9 g n-octanol + 2 PO | 7.25 | +1.75 |
| 10 | normal 40° C. | 28.8 g standard prepraration E +0.3 g enzyme mixture +0.9 g n-octanol + 2 PO | 7.50 | +2.00 |

We claim:

1. A composition of matter comprising from about 0.1 to 5 parts by weight of at least one hydrolase enzyme and from about 0.1 to 10 parts by weight of an alkanol selected from the group consisting of a $C_8$–$C_{10}$ primary, straight-chain or branched chain alkanol and a $C_8$–$C_{10}$ primary, straight-chain or branched chain alkanol propoxylated with from 1 to 2 moles of propylene oxide per mole of alkanol, said composition being useful as a cleaning booster to dishwashing compositions and being present therein in an amount effective to improve the removal of a food substance from a food containing substrate at washing temperatures of about 40° C., the balance of said composition comprising polymeric alkali metal phosphate and/or phosphate substitutes, alkali metal silicates, and alkali metal carbonates.

2. The composition of claim 1 wherein said alkanol is propoxylated with from 1 to 2 moles of propylene oxide per mole of alkanol.

3. The composition of claim 1 wherein said hydrolase enzyme is selected from the group consisting of amylases, proteases and lipases.

4. The composition of claim 3 comprising from about 0.5 to 3 parts by weight of said enzyme and from about 0.5 to 5 parts by weight of said alkanol.

5. The composition of claim 4 wherein said enzyme is a mixture of amylase and protease and said alkanol is selected from the group consisting of n-octanol, n-decanol propoxylated with 2 moles of propylene oxide per mole of n-decanol, 2-ethylhexanol, isononyl alcohol, isodecanol, and n-octanol propoxylated with 2 moles of propylene oxide per mole of n-octanol.

6. The composition of claim 5 comprising about 1 part by weight of said enzyme and about 3 parts by weight of said alkanol.

7. The composition of claim 1 wherein said enzyme is a mixture of amylase and protease and said alkanol is selected from the group consisting of n-octanol, n-decanol propoxylated with 2 moles of propylene oxide per mole of n-decanol, 2-ethylhexanol, isononyl alcohol, isodecanol, and n-octanol propoxylated with 2 moles of propylene oxide per mole of n-octanol.

8. The composition of claim 1 comprising from about 0.5 to 3 parts by weight of said enzyme and from about 0.5 to 5 parts by weight of said alkanol.

9. A dishwashing composition comprising (a) at least one polymeric alkali metal phosphate and/or phosphate substitute; (b) at least one alkali metal silicate; (c) at least one alkali metal carbonate; and (d) a combination of (i) from about 0.1 to 5 parts by weight of at least one hydrolase enzyme and (ii) from about 0.1 to 10 parts by weight of at least one alkanol selected from the group consisting of a $C_8$–$C_{10}$ primary, straight-chain or branched alkanol and a $C_8$–$C_{10}$ primary, straight-chain or branched alkanol propoxylated with from 1 to 2 moles of propylene oxide per mole of alkanol, said combination being present in an amount effective to improve the removal of a food substance from a food-containing substrate at washing temperatures of about 40° C.

10. The dishwashing composition of claim 9, wherein said hydrolase enzyme is selected from the group consisting of amylases, proteases and lipases.

11. The dishwashing composition of claim 10 comprising from about 0.5 to 3 parts by weight of said at least one enzyme and from about 0.5 to 5 parts by weight of said alkanol.

12. The dishwashing composition of claim 4, wherein said enzyme is a mixture of amylase and protease and said alkanol is selected from the group consisting of n-octanol, n-decanol provided with 2 moles of propylene oxide per mole of n-decanol, 2-ethylhexanol, isononyl alcohol, isodecanol, and n-octanol propoxylated with 2 moles of propylene oxide per mole of n-octanol.

13. The dishwashing composition of claim 12, comprising about 1 part by weight of said enzyme and about 3 parts by weight of said alkanol.

14. The dishwashing composition of claim 9 comprising:

from 0 to about 50% by weight of a polymeric alkali metal phosphate selected from the group consisting of alkali metal diphosphates and alkali metal triphosphates;

from 0 to about 60% by weight of a suitable phosphate substitute, wherein at least one of said suitable phosphate substitutes or at least one of said polymeric alkali metal phosphates is present;

from about 10% to 60% by weight of at least one alkali metal silicate selected from the group consisting of alkali metal metasilicates;

from about 2% to 4% by weight of sodium carbonate;

from about 0.1% to 5% by weight of a hydrolase enzyme or enzyme mixture;

from about 0.1% to 10% by weight of an alkanol selected from the group consisting of a $C_8$–$C_{10}$ primary, straight-chain or branched-chain alkanol and a $C_8$–$C_{10}$ primary, straight-chain or branched-chain alkanol propoxylated with from 1 to 2 moles of propylene oxide per mole of alkanol;

and additionally comprising from 0 to about 20% by weight of sodium hydrogen carbonate;

from about 1% to 20% by weight of waterglass having an alkali metal oxide to silicon dioxide ratio of between about 1:2 and 1:4;

from 0 to about 10% by weight of active oxygen donors and activators therefor; and from 0 to about 5% by weight of at least one low-foaming nonionic surfactant selected from the group consisting of alkylene oxide adducts with $C_{12}$–$C_{18}$ alkanols, nonylphenol or with polypropylene glycols having a molecular weight of from 900 to 4000.

15. The dishwashing composition of claim 14, comprising:

from about 10% to 40% by weight of said alkali phosphate, from about 5% to 50% by weight of said suitable phosphate substitute selected from the group consisting of (1) at least one water-insoluble, complexing zeolite of the NaA or NaX type or mixtures thereof and (2) at least one water-soluble organic complexing agent for calcium;

from about 20% to 50% by weight of said alkali metasilicate;

from about 5% to 30% by weight of said sodium carbonate;

from about 5% to 20% by weight of said sodium hydrogen carbonate;

from about 1% to 15% by weight of said waterglass;

from about 0.5% to 3% by weight of said hydrolase enzyme wherein said hydrolase enzyme is selected from the group consisting of amylases, proteases and lipases;

from about 0.5% to 5% by weight of said alkanol;

from about 0.5% to 5% by weight of said donors and activators; and from about 0.5% to 2% by weight of said nonionic surfactant.

16. The dishwashing composition of claim 15, wherein said alkanol is propoxylated with from 1 to 2 moles of propylene oxide per mole of alkanol.

17. The dishwashing composition of claim 15, wherein said enzyme is a mixture of amylase and protease and said alkanol is selected from the group consisting of n-octanol, n-decanol propoxylated with 2 moles of propylene oxide per mole of n-decanol, 2-ethylhexanol, isononyl alcohol, isodecanol, and n-octanol propoxylated with 2 moles of propylene oxide per mole of n-octanol.

18. The dishwashing composition of claim 17, comprising about 1% by weight of said enzyme and about 3% by weight of said alkanol.

19. The dishwashing composition of claim 14, wherein said enzyme is a mixture of amylase and protease and said alkanol is selected from the group consisting of n-octanol, n-decanol propoxylated with 2 moles of propylene oxide per mole of n-decanol, 2-ethylhexanol, isononyl alcohol, isodecanol, and n-octanol propoxylated with 2 moles of propylene oxide per mole of n-octanol.

* * * * *